United States Patent [19]

Bankstahl et al.

[11] Patent Number: 4,887,983

[45] Date of Patent: Dec. 19, 1989

[54] CHAIN DRIVE MARINE PROPULSION SYSTEM WITH DUAL COUNTERROTATING PROPELLERS

[75] Inventors: Herbert A. Bankstahl, Fond du Lac; Neil A. Newman, Omro, both of Wis.

[73] Assignee: Brunswick Corporation, Skokie, Ill.

[21] Appl. No.: 242,357

[22] Filed: Sep. 9, 1988

[51] Int. Cl.[4] ..... B63H 25/42

[52] U.S. Cl. ..... 440/57; 440/75

[58] Field of Search ..... 440/53, 54, 57, 58, 440/75, 80, 81, 83, 86; 416/128, 129 R, 129 A

[56] References Cited

U.S. PATENT DOCUMENTS

| | | | |
|---|---|---|---|
| 902,362 | 10/1908 | Adnson | 440/75 |
| 2,064,195 | 12/1936 | De Michels | 440/75 |
| 3,478,620 | 11/1969 | Shimanckas | 440/75 |
| 3,795,219 | 3/1974 | Peterson | 440/58 |
| 4,273,545 | 6/1981 | Pehrsson | 440/75 |

FOREIGN PATENT DOCUMENTS

| | | | |
|---|---|---|---|
| 1310472 | 3/1973 | United Kingdom | 440/81 |

*Primary Examiner*—Joseph F. Peters, Jr.
*Assistant Examiner*—Stephen P. Avila
*Attorney, Agent, or Firm*—Andrus, Sceales, Starke & Sawall

[57] ABSTRACT

A chain drive marine propulsion system employs dual counterrotating propellers. The propellers are mounted to concentric propeller shafts disposed in the lower end of a depending gearcase. The concentric propeller shafts are each provided with a lower sprocket engaging a chain. A counterrotation mechanism is provided for driving the chains in opposite directions, thereby resulting in counterrotation of the propellers. Various embodiments for driving the chains in opposite directions are disclosed.

14 Claims, 3 Drawing Sheets

FIG. 2
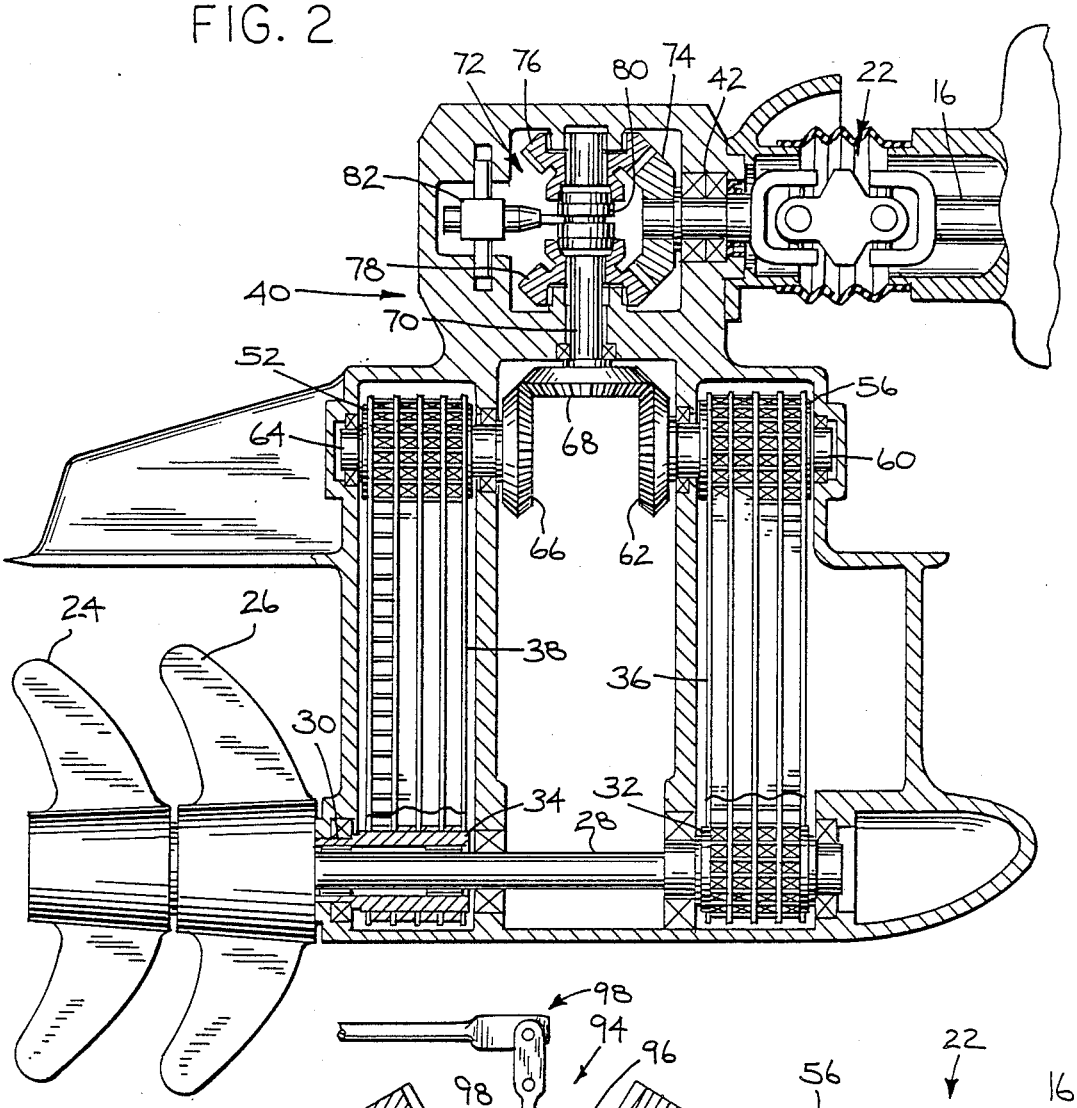
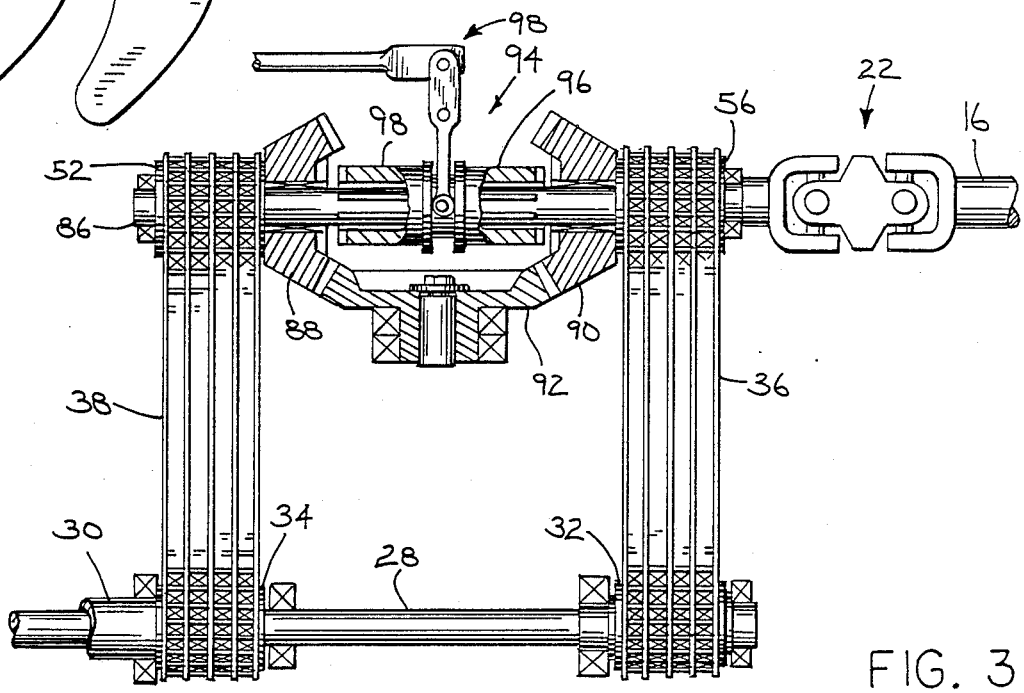
FIG. 3

CHAIN DRIVE MARINE PROPULSION SYSTEM WITH DUAL COUNTERROTATING PROPELLERS

BACKGROUND AND SUMMARY

This invention relates to a marine propulsion system, and more particularly to such a system employing counterrotating propellers.

It has been found that providing a single propeller for a marine propulsion system results in imbalanced propeller torque leading to hydrodynamic inefficiencies. Utilization of dual counterrotating propeller substantially reduces or eliminates such inefficiencies.

The present invention discloses a marine propulsion system utilizing dual counterrotating propeller, along with a chain drive system for driving the propellers. The marine propulsion system according to the present invention comprises first and second concentric propeller shafts mounted to a depending gearcase, with each propeller shaft having a portion projecting from the gearcase. A first propeller is mounted to the projecting portion of the first propeller shaft, and a second propeller is mounted to the projecting portion of the second propeller shaft. A chain drive drivingly interconnects the first and second propeller shafts with the engine crankshaft. The chain drive includes a first portion for driving the first propeller shaft and a second portion for driving the second propeller shaft. Counterrotation drive means is provided for driving the first and second portions of the chain in opposite directions, thereby providing rotation of the first and second propeller shafts in opposite rotational directions.

In one embodiment, the counterrotation drive means includes one or more intermediate shafts carrying first and second upper sprockets. The first portion of the chain drive is provided about the first upper sprocket and a lower sprocket mounted to either the first or second propeller shaft. The second portion of the chain drive is provided about the second upper sprocket and a lower sprocket mounted to the other of the propeller shafts. The counterrotation drive means causes the first and second portions of the chain drive to be driven in opposite directions, resulting in counterrotation of the first and second propeller shafts. An input shaft, driven by the engine crankshaft, is rotatably disposed in the upper portion of the depending gearcase. The counterrotation drive means includes a first drive means provided between the input shaft and the first upper sprocket for driving the first upper sprocket in a first rotational direction, thereby driving the first portion of the chain drive in a first direction. The counterrotation drive means further includes a second drive means disposed between the input shaft and the second upper sprocket for driving the second upper sprocket in a second rotational direction opposite that of the first upper sprocket, and driving the second portion of the chain drive in a direction opposite that of the first portion of the chain drive. In one embodiment, the first drive means comprises an input gear connected to and rotatable with the input shaft, and engageable with a gear connected to and rotatable with the first upper sprocket. The second drive means comprises an input sprocket connected to and rotatable with the input shaft, and a sprocket connected to and rotatable with the second upper sprocket. A drive chain is provided about the input sprocket and the sprocket connected to the second upper sprocket. With this arrangement, rotation of the input shaft results in rotation of the first and second upper sprockets in opposite rotational directions. The first and second portions of the chain drive are thus driven in opposite directions, resulting in rotation of the dual propellers in opposite directions.

Various other embodiments are disclosed for imparting counterrotation to the first and second upper sprockets, and thereby opposite directions of movement of the first and second portions of the chain drive.

BRIEF DESCRIPTION OF THE DRAWINGS

The drawings illustrate the best mode presently contemplated of carrying out the invention.

In the drawings:

FIG. 2 is a partial elevation view similar to FIG. 1, showing an alternate embodiment for imparting counterrotation to the first and second upper sprockets;

FIG. 3 is a partial elevation view similar to FIGS. 1 and 2, showing another alternate embodiment for imparting counterrotation to the first and second upper sprockets;

DETAILED DESCRIPTION OF THE PREFERRED EMBODIMENT

Figure 1:
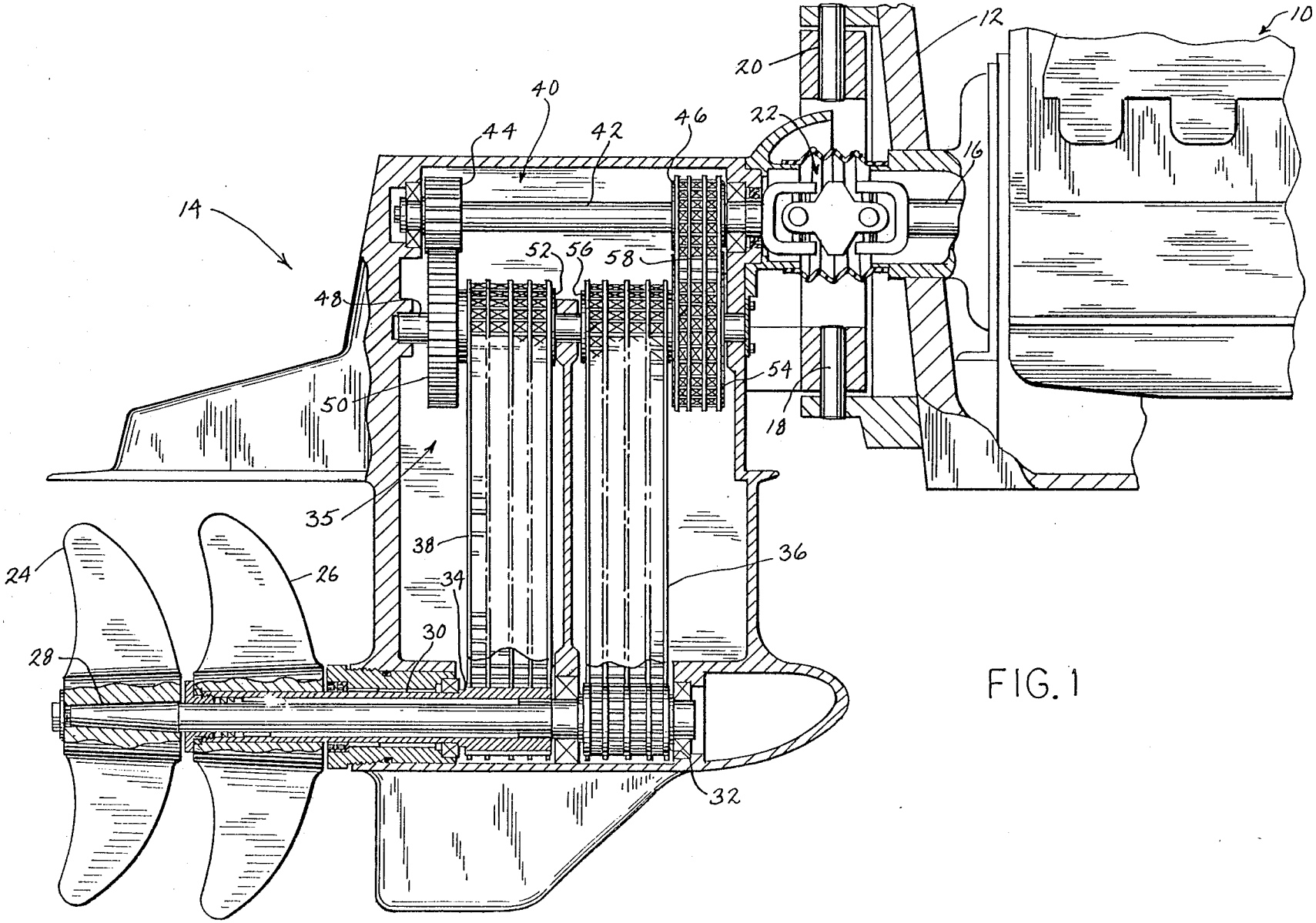
FIG. 1 is a partial elevation view, partially in section, showing one embodiment of the chain drive counterrotating propeller marine propulsion mechanism of the invention.

With reference to FIG. 1, an inboard/outboard marine propulsion system generally includes an engine 10 mounted in the interior of a boat adjacent its transom 12, and a depending gearcase 14 mounted exteriorly of transom 12. Engine 10 includes a crankshaft 16 extending substantially parallel to the boat axis and transversely to transom 12.

Gearcase 14 is mounted to the exterior of transom 12 for pivoting horizontal movement about a steering axis defined by steering pins 18, 20. Gearcase 14 is vertically pivotable about a tilt axis defined by a universal joint 22 connected to engine crankshaft 16.

A pair of propellers 24, 26 are mounted to the lower end of gearcase 14. Rear propeller 24 is mounted to the portion of an inner propeller shaft 28 which projects rearwardly from gearcase 14. Inner propeller shaft 28 extends concentrically within an outer propeller shaft 30. Front propeller 26 is connected to the portion of outer propeller shaft 30 projecting rearwardly from gearcase 14. Inner and outer propeller shafts 28, 30 are rotatably mounted in the lower end of depending gearcase 14.

A lower front sprocket 32 is fixed to the forward end of inner propeller shaft 28, and is rotatable therewith. A lower rear sprocket 34 is fixed to the forward end of outer propeller shaft 30, and is rotatable therewith. A chain drive 35 is provided within gearcase 14, and includes a first chain portion 36 interconnected with lower front sprocket 32. A second chain portion 38 of chain drive 35 is interconnected with lower rear sprocket 34.

A counterrotation drive means, shown generally at 40, drivingly interconnects engine crankshaft 16 with chain drive 35. Counterrotation drive means 40 includes an upper input shaft 42 drivingly interconnected with engine crankshaft 16 through universal joint 22. Input shaft 42 has an input gear 44 fixed to its rearward end, and an input sprocket 46 fixed to its forward end.

An intermediate shaft 48 is mounted in gearcase 14 between input shaft 42 and propeller shafts 28, 30. A gear 50 is rotatably mounted to the rearward end of intermediate shaft 48, and is aligned with input gear 44. Gear 50 is mounted to and rotatable with an upper rear sprocket 52 rotatably mounted to intermediate shaft 48. Upper rear sprocket 52 is interconnected with second chain portion 38 so that second chain portion 38 spans between and engages upper rear sprocket 52 and lower rear sprocket 34. With this construction, rotation of input shaft 42 is transferred through input gear 44 and gear 50 to upper rear sprocket 52, thereby causing rotation of upper rear sprocket 52 and movement of second chain portion 38 about lower rear sprocket 34. Such rotation of lower rear sprocket 34 is transferred through outer propeller shaft 30 to front propeller 26.

An intermediate sprocket 54 is rotatably mounted to the forward end of intermediate shaft 48, and is connected to and rotatable with an upper front sprocket 56. Intermediate sprocket 54 is aligned with input sprocket 46 on input shaft 42. A drive chain 58 drivingly engages input sprocket 46 and intermediate sprocket 54. First chain portion 36 spans between and engages upper front sprocket 56 and lower front sprocket 32. With this construction, rotation of input shaft 42 is transferred through drive sprocket 46 and drive chain 58 to intermediate sprocket 54, and thereby to upper front sprocket 56, which rotates in a direction opposite to that of upper rear sprocket 52. In this manner, first and second chain portions 36, 38 are driven in opposite directions by upper front and rear sprockets 56, 52, respectively. Such opposite motion of first and second chain portions 36, 38 results in counterrotation of propeller shafts 28, 30, and thereby propellers 24, 26.

FIG. 2 illustrates an alternate embodiment for counterrotation drive 40, and like reference characters will be used where possible to facilitate clarity. As in FIG. 1, first and second chain portions 36, 38 are provided about lower front and rear sprockets 32, 34, respectively. In this embodiment, a pair of intermediate shafts are rotatably mounted in gearcase 14. A front rotatable intermediate shaft 60, to which upper front sprocket 56 is fixed, is provided at its leftward end with a bevel gear 62. A rear rotatable intermediate shaft 64, to which upper rear sprocket 52 is mounted, is provided at its rightward end with a bevel gear 66 which faces bevel gear 62. Bevel gears 62, 66 are in substantial alignment with each other.

A drive gear 68 engages facing bevel gears 62, 66, and is mounted to a substantially vertical drive shaft 70. In this embodiment, a reversing transmission, shown generally at 72, is interconnected between drive shaft 70 and input shaft 42. Reversing transmission 72 includes an input bevel gear 74 mounted to input shaft 42, and forward and reverse gears 76, 78 mounted for free rotation about drive shaft 70. As is known, input bevel gear 74 engages forward and reverse gears 76, 78, providing counterrotation of such gears. A clutching mechanism, including a clutch 80 drivingly engaged with drive shaft 70 and a shifting mechanism 82, selectively engages either forward gear 76 or reverse gear 78 with clutch 80, thereby providing rotation of drive shaft 70 in a selected direction. Rotation of drive shaft 70 is transferred through drive gear 68 to facing bevel gears 62, 66 provided on front and rear intermediate shafts 60, 64, causing rotation of intermediate shafts 60, 64 in opposite directions. In this manner, first and second chain portions 36, 38 are driven in opposite directions, resulting in counterrotation of propellers 24, 26 through propeller shafts 28, 30.

FIG. 3 shows another embodiment for employing a reversing transmission in connection with the chain drive dual counterrotating propeller system of the invention. In this embodiment, upper front sprocket 56 and upper rear sprocket 52 are mounted for free rotation about an intermediate shaft 86. A bevel gear 88 is fixed to and rotatable with upper rear sprocket 52 about shaft 86, and a facing bevel gear 90 is fixed to and rotatable with upper front sprocket 56 about shaft 86.

As a means for transferring rotation between facing bevel gears 88 and 90, an idler gear 92 is mounted between and engageable with bevel gears 88, 90. A reversing transmission 94 is mounted to intermediate shaft 86 for selectively providing either forward or reverse operation. Reversing transmission 94 includes forward and reverse clutch sleeves 96, 98 slidably mounted to intermediate shaft 86 and splined thereto for rotation therewith. A shifting linkage 98 is provided for selectively engaging either forward clutch sleeve 96 with bevel gear 90 or reverse clutch sleeve 98 with bevel gear 88. For example, movement of forward clutch sleeve 96 rightwardly into engagement with bevel gear 90 results in rotation of bevel gear 90 along with intermediate shaft 86. Such rotation of bevel gear 90 causes rotation of upper front sprocket 56, and thereby movement of chain portion 36 about lower front sprocket 32. Rotation of bevel gear 90 is transferred through idler gear 92 to bevel gear 88, which then rotates in a direction opposite that of bevel gear 90. Such rotation of bevel gear 88 results in rotation of upper rear sprocket 52, which drives second chain portion 38 in a direction opposite that of first chain portion 36, thereby resulting in counterrotation of propellers 24, 26.

Figure 4:
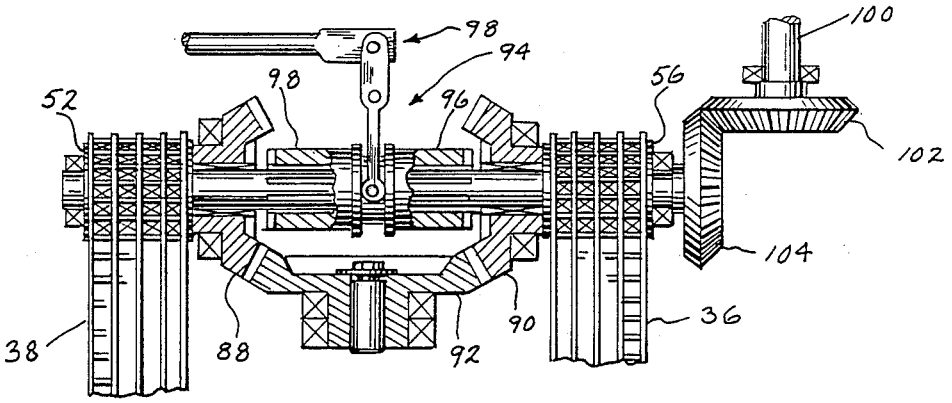
FIG. 4 is a partial elevation view showing an embodiment similar to FIG. 3 employing a vertical drive shaft.

FIG. 4 illustrates an embodiment of the present invention similar to that shown in FIG. 3. In the embodiment of FIG. 4, however, a vertical drive shaft 100 is provided. Vertical drive shaft 100 may be that as is used in outboard motor applications. Vertical drive shaft 100 is provided at is lower end with a bevel gear 102, engageable with a bevel gear 104 provided at the rightward end of intermediate shaft 86. With this construction, rotation of vertical drive shaft 100 is transferred to intermediate shaft 86, and through reversing transmission 94 to bevel gears 88, 90.

Figure 5:
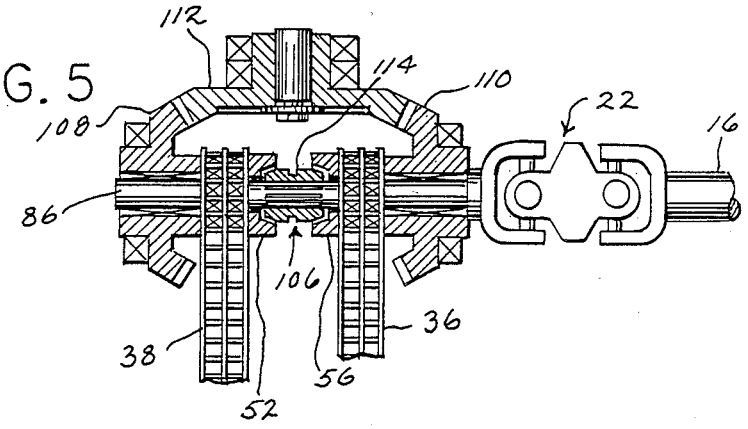
FIG. 5 is a partial elevation view similar to FIGS. 1, 2 and 3, showing yet another alternate embodiment for imparting counterrotation to the first and second upper sprockets.

FIG. 5 illustrates yet another embodiment for carrying out the chain drive system of the invention. In this embodiment, a reversing transmission 106 is disposed between upper rear sprocket 52 and upper front sprocket 56. Upper rear sprocket 52 is connected to a bevel gear 108, and upper front sprocket 56 is connected to a bevel gear 110. An idler gear 112 is disposed between and engageable with bevel gears 108, 110. Reversing transmission 106 includes a slidable clutch 114 which is movable on intermediate shaft 86 for selectively engaging either upper rear sprocket 52 or upper front sprocket 56. Upon such engagement with either of upper sprockets 52 or 56, rotation of the engaged sprocket causes rotation of its associated bevel gear, which is transferred through idler gear 112 to the bevel gear associated with the nonengaged upper sprocket, thereby causing rotation in a direction opposite that of the driven sprocket. In this manner, opposite movement is imparted to first and second chain portions 36, 38.

Figure 6:
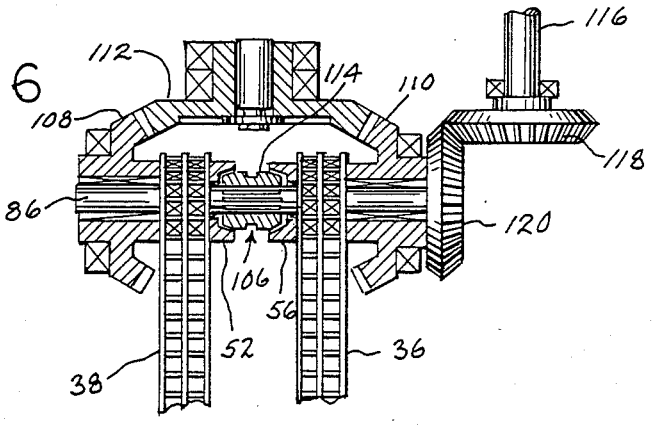
FIG. 6 is a partial elevation view showing an embodiment similar to FIG. 5 employing a vertical drive shaft.

FIG. 6 illustrates an embodiment similar to that of FIG. 5. In this embodiment, a vertical drive shaft 116 is employed for imparting rotation to intermediate shaft 86 through a bevel gear 118 mounted to vertical drive shaft 116 and a mating bevel gear 120 mounted to intermediate shaft 86. In this manner, the embodiment of FIG. 5 can be adapted for use in connection with an outboard type marine propulsion system.

With the construction provided by the above-described embodiments of the invention, the hydrodynamic efficiency resulting from employment of dual counterrotating propellers can be achieved. Additionally, the embodiments of the invention provide high mechanical efficiency normally resulting from employment of chain drives and parallel shafting. It is possible to transfer relatively high amounts of horsepower by utilizing a chain drive system, while at the same time reducing frontal area of the submerged portion of gearcase 14 by providing separate housings for the vertical chain runs.

While the present invention has been described primarily with reference to an inboard/outboard stern drive system, it is to be understood that the invention can be advantageously employed in an outboard configuration, as shown in FIGS. 4 and 6.

Various alternatives and modifications are contemplated as being within the scope of the following claims particularly pointing out and distinctly claiming the invention.

We claim:

1. In a marine drive for a boat, said marine drive including an engine having a rotatable crankshaft and a depending gearcase, the improvement comprising:

first and second concentric propeller shafts mounted to said depending gearcase, each said propeller shaft having a portion projecting from said gearcase;

a first propeller mounted to said projecting portion of said first propeller shaft;

a second propeller mounted to said projecting portion of said second propeller shaft;

one or more intermediate shafts disposed between said engine crankshaft and said first and second propeller shafts, said one or more intermediate shafts carrying first and second sprockets;

chain means drivingly interconnected between said first and second sprockets and said first and second propeller shafts, said chain means including a first portion for driving said first propeller shaft and a second portion for driving said second propeller shaft; and counterrotation drive means for driving said first and second portions of said chain means in opposite directions, and thereby providing rotation of said first and second propeller shafts in opposite rotational directions, wherein said counterrotation drive means causes said first and second sprockets on said one or more intermediate shafts to be driven in opposite rotational directions, thereby resulting in driving of said first and second portions of said chain means in opposite directions.

2. The improvement according to claim 1, further comprising an input shaft rotatable in response to rotation of said engine crankshaft, and wherein said counterrotation drive means comprises first drive means disposed between said input shaft and said first sprocket for driving said first sprocket in a first direction of rotation, and further comprises second drive means disposed between said input shaft and said second sprocket for driving said second sprocket in a second direction of rotation opposite to said first direction of rotation.

3. The improvement according to claim 2, wherein one of said first or second drive means comprises a first drive gear mounted to said input shaft and rotatable therewith, said first drive gear being engageable with a second drive gear mounted to one of said first or second sprockets and rotatable therewith for driving said first or second sprocket in response to rotation of said first drive gear.

4. The improvement according to claim 2, wherein one of said first or second drive means comprises a first drive sprocket mounted to said drive shaft and rotatable therewith, a second drive sprocket mounted to one of said first or second sprockets carried by said one or more intermediate shafts, and a drive chain engageable with said first and second drive sprockets for driving one of said first or second sprockets carried by said intermediate shaft in response to rotation of said first drive sprocket.

5. The improvement according to claim 1, further comprising an input shaft rotatable in response to rotation of said engine crankshaft, and wherein said counterrotation drive means comprises a first bevel gear mounted to and rotatable with said first sprocket, a second bevel gear mounted to and rotatable with said second sprocket, said first and second bevel gears being aligned with and facing each other, and a drive bevel gear rotatable in response to said input shaft and simultaneously engageable with said first and second bevel gears, so that rotation of said drive bevel gear simultaneously causes rotation of said first and second sprockets in opposite rotational directions for driving said first and second portions of said chain means in opposite directions.

6. The improvement according to claim 5, further comprising a reversing transmission interconnected between said input shaft and said drive bevel gear for selectively driving said drive bevel gear in either a first or second rotational direction to selectively impart forward or reverse movement of said boat.

7. The improvement according to claim 1, wherein said one or more intermediate shafts comprises an input shaft interconnected with said engine crankshaft and rotatable in response thereto, said first and second sprockets being rotatably mounted to said input shaft, and wherein said counterrotation drive means comprises:

a first gear mounted to and rotatable with said first sprocket and a second gear mounted to and rotatable with said second sprocket, said first and second gears being freely rotatable about said input shaft;

drive means mounted to said drive shaft and rotatable therewith;

clutch means for selectively engaging said drive means with either said first gear or said second gear to thereby cause rotation of said first gear or said second gear in response to rotation of said input shaft; and transfer means disposed between and engageable with said first and second gears for driving one of said first or second gears in response to rotation of the other of said first or second gears, said first and second gears being driven in opposite rotational directions for causing movement of said first and second portions of said chain means in opposite directions.

8. The improvement according to claim 7, wherein said first and second gears mounted to said first and second sprockets each comprise a bevel gear, and wherein said transfer means comprises an idler bevel gear disposed between and engageable with said first and second gears.

9. The improvement according to claim 7, wherein said input shaft is connected to said engine crankshaft through a universal joint.

10. The improvement according to claim 7, wherein said input shaft is connected to a vertically extending drive shaft by means of cooperating bevel gears mounted to said input shaft and said drive shaft.

11. The improvement according to claim 1, wherein said one or more intermediate shafts comprises an input shaft interconnected with said engine crankshaft and rotatable in response thereto, said first and second sprockets being rotatably mounted to drive means comprises:

a first gear mounted to and rotatable with said first sprocket and a second gear mounted to and rotatable with said second sprocket;

input means mounted to said drive shaft and rotatable therewith;

clutch means for selectively engaging said drive means with either said first sprocket or said second sprocket to thereby cause rotation of said first sprocket or said second sprocket in response to rotation of said input shaft, with said first or second gears rotating in response to rotation of said first or second sprockets, respectively; and transfer means disposed between and engageable with said first and second gears for driving one of said gears in response to rotation of the other of said gears, said gears being driven in opposite rotational directions for causing movement of said first and second portions of said chain means in opposite rotational directions.

12. The improvement according to claim 11, wherein said first and second gears mounted to said first and second sprockets each comprise a bevel gear, and wherein said transfer means comprises an idler bevel gear disposed between and engageable with said first and second gears.

13. The improvement according to claim 11, wherein said input shaft is connected to said engine crankshaft through a universal joint.

14. The improvement according to claim 11, wherein said input shaft is connected to a vertically extending drive shaft by means of cooperating bevel gears mounted to said input shaft and said drive shaft.

* * * * *

UNITED STATES PATENT AND TRADEMARK OFFICE

CERTIFICATE OF CORRECTION

PATENT NO. : 4,887,983

DATED : December 19, 1989

INVENTOR(S) : Bankstahl et al

It is certified that error appears in the above-identified patent and that said Letters Patent is hereby corrected as shown below:

Claim 11, Col. 7, Line 26, After "to" insert --- said input shaft, and wherein said counterrotation ---;

Claim 11, Col. 8, Line 1, Delete "input" and substitute therefor --- drive ---;

Claim 11, Col. 8, Line 1, Delete "drive" and substitute therefor --- input ---.

Signed and Sealed this

Twenty-eighth Day of May, 1991

*Attest:*

HARRY F. MANBECK, JR.

*Attesting Officer*

*Commissioner of Patents and Trademarks*